US007392626B2

(12) United States Patent
Farrend

(10) Patent No.: US 7,392,626 B2
(45) Date of Patent: Jul. 1, 2008

(54) FLOOR BRACKET

(76) Inventor: Blair Farrend, Box 379, Elie, Manitoba (CA) R0H 0H0

( * ) Notice: Subject to any disclaimer, the term of this patent is extended or adjusted under 35 U.S.C. 154(b) by 337 days.

(21) Appl. No.: 11/111,817

(22) Filed: Apr. 22, 2005

(65) Prior Publication Data

US 2005/0246985 A1 Nov. 10, 2005

Related U.S. Application Data

(60) Provisional application No. 60/567,798, filed on May 5, 2004.

(51) Int. Cl.
*E04B 5/00* (2006.01)

(52) U.S. Cl. ..... 52/273; 52/288.1; 16/16

(58) Field of Classification Search ..... 52/273, 52/288.1; 16/4, 6, 7, 16
See application file for complete search history.

(56) References Cited

U.S. PATENT DOCUMENTS

| | | | | | |
|---|---|---|---|---|---|
| 1,770,215 | A * | 7/1930 | McIntyre | 16/16 |
| 1,836,375 | A * | 12/1931 | Kernochan | 16/10 |
| 1,988,603 | A * | 1/1935 | McLaren et al. | 52/273 |
| 2,211,574 | A * | 8/1940 | McNieholas | 52/273 |
| 2,238,946 | A * | 4/1941 | Roberts | 16/16 |
| 2,487,571 | A * | 11/1949 | Maxwell | 16/5 |
| 2,506,030 | A * | 5/1950 | Mapes | 16/7 |
| 2,563,615 | A * | 8/1951 | Paul | 16/16 |
| 2,670,494 | A * | 3/1954 | Owens | 16/16 |
| 2,980,943 | A * | 4/1961 | Calandro et al. | 16/7 |
| 3,062,342 | A * | 11/1962 | Clements | 52/273 |
| 3,086,262 | A * | 4/1963 | Krantz | 52/273 |
| 3,092,869 | A * | 6/1963 | Stump | 16/7 |
| 3,201,909 | A * | 8/1965 | Heinrich | 52/288.1 |
| 3,206,806 | A * | 9/1965 | Powell | 52/287.1 |
| 3,464,177 | A * | 9/1969 | Amato | 52/288.1 |
| 3,663,986 | A * | 5/1972 | Harby | 16/7 |
| 3,805,862 | A * | 4/1974 | Jirovetz | 16/16 |
| 3,997,937 | A * | 12/1976 | Manguso | 16/6 |
| 4,653,138 | A * | 3/1987 | Carder | 16/4 |
| 4,682,925 | A * | 7/1987 | Shields | 411/461 |
| 4,843,676 | A * | 7/1989 | Makinson | 16/4 |
| 4,875,250 | A * | 10/1989 | Chaintreuil | 16/4 |
| 5,058,340 | A * | 10/1991 | Muller | 52/222 |
| 5,203,640 | A * | 4/1993 | Pourtau et al. | 403/403 |
| 5,289,663 | A * | 3/1994 | Schluter | 52/287.1 |
| 5,475,953 | A * | 12/1995 | Greenfield | 52/179 |
| 5,551,820 | A * | 9/1996 | Catalano, Jr. | 411/485 |
| 5,584,149 | A * | 12/1996 | Wilson | 52/98 |
| 5,642,597 | A * | 7/1997 | Hendrickson | 52/715 |
| 5,661,874 | A * | 9/1997 | Latour | 16/4 |
| 5,930,973 | A * | 8/1999 | Preece | 52/741.4 |
| 5,943,829 | A * | 8/1999 | Wilson | 52/98 |
| 6,186,605 | B1 * | 2/2001 | Nelson | 312/140.4 |
| 2007/0144091 | A1 * | 6/2007 | Brindle | 52/287.1 |

* cited by examiner

*Primary Examiner*—Robert Canfield
*Assistant Examiner*—Brent W Herring
(74) *Attorney, Agent, or Firm*—Adrian D. Battison; Michael R. Williams; Ryan W. Dupuis

(57) ABSTRACT

A smooth edge strip for engaging a carpet edge at a floor edge adjacent a wall is held in place by a bracket having a bracket body defining a mounting plate for attachment to the wall at the floor edge and a channel portion for receiving the smooth edge strip so as to hold the smooth edge strip flat on the floor. The channel portion includes an upper leg across the top of the strip which connects to the wall plate at the corner with the floor by a downwardly inclined portion. The wall plate is arranged at an angle to provide spring bias tending to hold the channel and the strip held thereby in contact with the floor.

2 Claims, 4 Drawing Sheets

FLOOR BRACKET

This application claims priority under 35 U.S.C. 119 from U.S. provisional application Ser. No. 60/567,798 filed May 5, 2004.

This invention relates to a bracket for use in holding a smooth edge strip to a floor for attachment of carpet thereto.

BACKGROUND OF THE INVENTION

The laying of carpet on flooring has for many years used a product known as "smooth edge" for holding the edge of the carpet against lifting and against sliding inwards away from the wall or other edge position at which the smooth edge is applied. Smooth edge consists of a strip of plywood with a series of nails punched through the strip so as to project upwardly from the upper surface in a row of outwardly inclined spikes which grasp the edge of the carpet. The width of the strip can vary to provide increased numbers of spikes where necessary. The plywood strip is generally attached to the floor by nailing through the strip. This technique is used widely and has been fully satisfactory where the strip can be readily fastened to the floor by nailing or adhesive. The strip is however of no value when the fastening to the floor is impossible or unsatisfactory, thus requiring the use of other techniques for fastening the carpet at the edge.

SUMMARY OF THE INVENTION

It is one object of the present invention to provide a bracket which can be used to hold down a smooth edge strip to a floor.

According to the invention there is provided a bracket for use in attachment of a smooth edge strip at a floor edge comprising:

a bracket body defining a mounting plate for attachment to a vertical wall surface at an edge of the floor;

and a channel portion for receiving the smooth edge strip;

the channel portion being attached to the mounting plate and extending therefrom so as to extend across the floor so as to hold the smooth edge strip flat on the floor.

Preferably the channel portion includes a first leg on one flat surface of the smooth edge strip and extending therefrom to the mounting plate and a second leg on the other flat surface of the smooth edge strip and attached to the first leg by a base extending around an edge of the smooth edge strip.

Preferably the base is arranged at the edge of the smooth edge strip remote from the wall.

Preferably the first leg is on top of the smooth edge.

Preferably the first leg includes a portion which is inclined downwardly from the top of the smooth edge to the corner between the wall and the floor.

Preferably the mounting plate is inclined relative to the channel portion by an angle greater than 90 degrees so that when attached to the wall there is a spring biasing force applied to the channel portion tending to press the channel portion against the floor.

Preferably the length of the first leg is substantially equal to the width of the smooth edge strip so that the inclined portion defines a shoulder arranged to locate the smooth edge strip against movement toward the wall.

According to a second aspect of the invention there is provided a combination comprising:

a wall;

a floor;

a smooth edge strip;

and a bracket for use in attachment of the smooth edge strip at the floor edge comprising:

a bracket body defining a mounting plate for attachment to a vertical wall surface at an edge of the floor;

and a channel portion for receiving the smooth edge strip;

the channel portion being attached to the mounting plate and extending therefrom so as to extend across the floor so as to hold the smooth edge strip flat on the floor.

The bracket is designed to resolve or eliminate issues with regard to the usefulness of the current product of "smooth edge" used in the installation of stretch-in carpets. In simple terms is a product that replaces the nails or adhesive products used to affix "smooth edge" strips to the existing flooring or various other underlayment substrates.

As the bracket can be used in virtually all situations where stretch-in carpet can be and is currently installed, there exists a very large general market into which the bracket can be introduced.

The bracket overcomes many of the issues with regard to installations over existing hardwood floors, ceramic tile, concrete flooring and/or concrete with in-floor radiant heating systems as it does not damage or alter the existing floor. Similarly stretch-in carpet could be installed in subsidized housing complexes where the home occupant is prohibited from damaging the existing floor. Additionally the bracket system permits a homeowner the option to install stretch-in carpet over virtually all vinyl or linoleum as well as laminate and tile floors without altering or damaging the flooring.

This product is superior in the flooring industry by eliminating possible damage of concrete and radiant floor heating. It will also eliminate the need for restretching and any use of adhesive, such as PL400 or similar adhesives well known in the industry. The present invention provides an arrangement which is a less expensive product and eliminates adhesive cure time. Also it avoids the problem that the adhesive may break free from concrete due to improper preparation. The product can also be used on any tiled flooring and can be attached to grout between cinder blocks normally used in high rise buildings. There is no time wasted cutting wood into strips of 5" and time to pull nails.

The product can be used for installing over existing hardwood, ceramic or marble tiles without damage to the material whatsoever, with the advantage that customers are able to install stretch-in carpet as opposed to a glue down carpet, allowing the opportunity to have the carpet removed to re-expose the hardwood or tile without damage.

Because of this product people have the opportunity to install stretch in carpets to their homes instead of limited glue down carpet. Therefore if they decide that they would like to have their hardwood or tiles again, there will be no damage to the floor when the carpet is removed.

Advantages of the invention include the following:

Eliminate nails, adhesives, drilling dowels;

Prevent damaging concrete, wood and ceramic, other;

Faster installation; will not rot or fail;

Easy removal/reusable;

odourless;

will repair damaged or failed smooth edge;

low cost;

more opportunity for purchaser, not limited to glue down applications or other alternate flooring.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
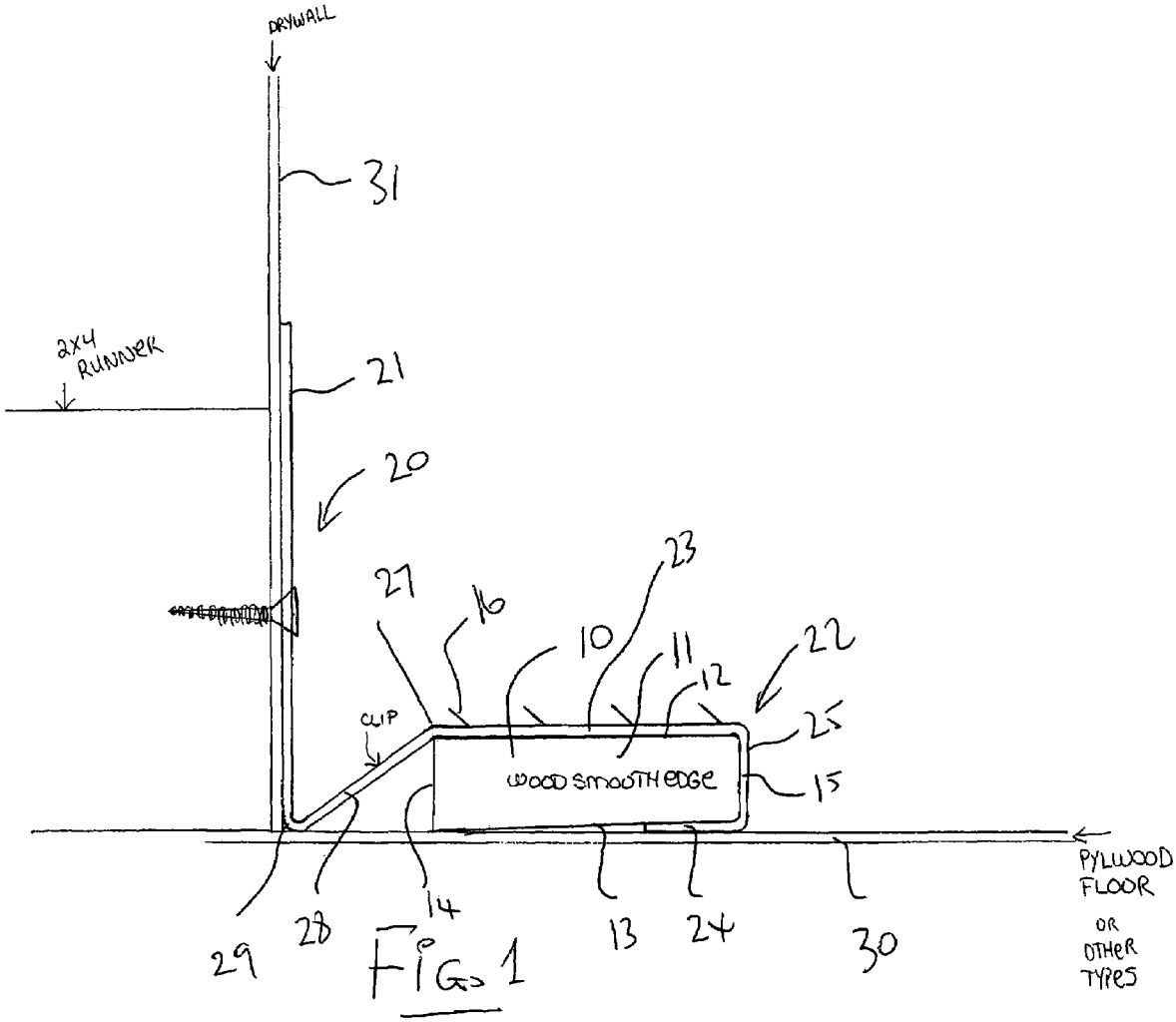
FIG. 1 is a cross sectional view showing an embodiment of bracket according to the present invention installed at a floor edge and holding a length of the smooth edge at the floor edge.
Figure 2:
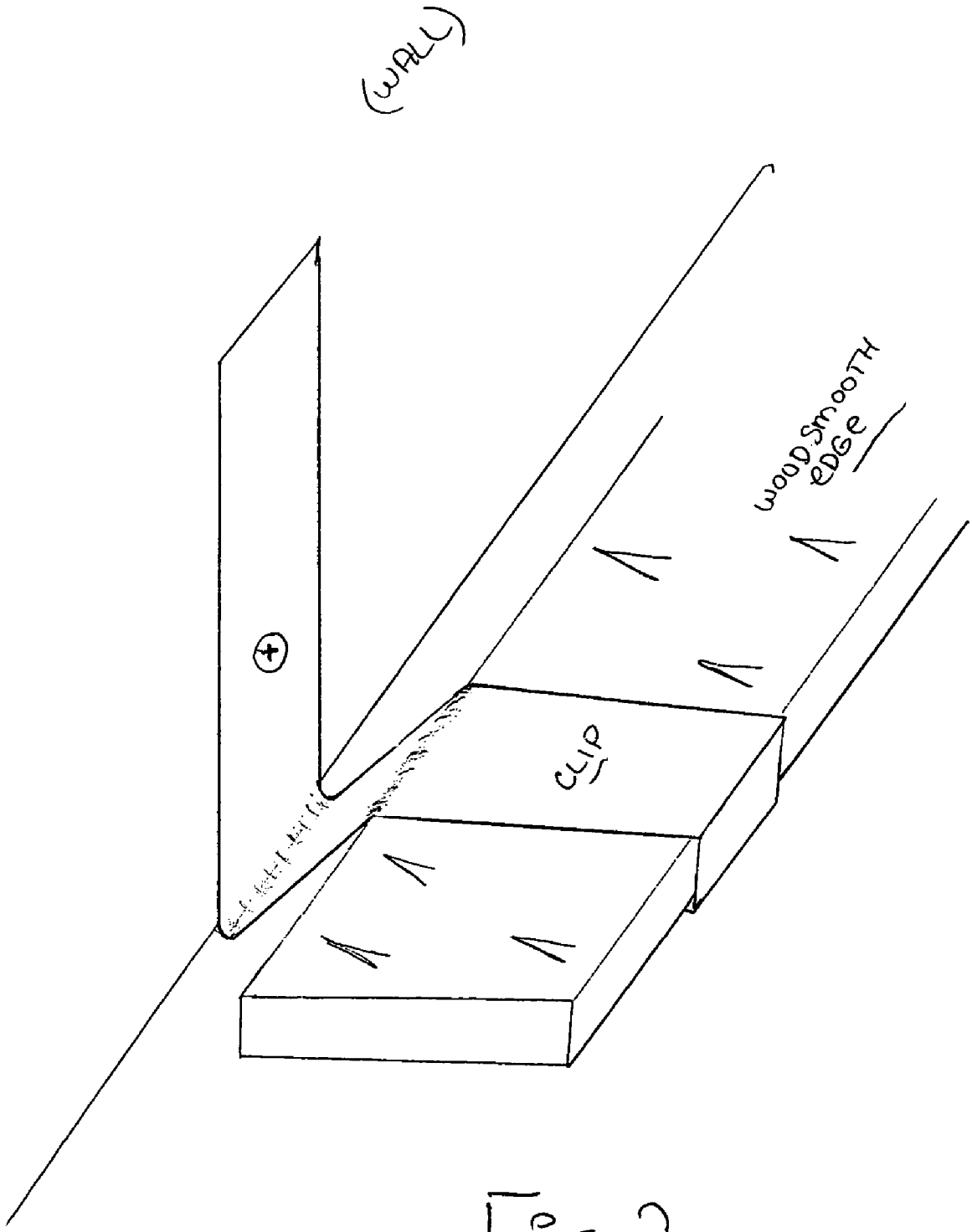
FIG. 2 is an isometric view of the bracket as installed in FIG. 1.
Figure 3:
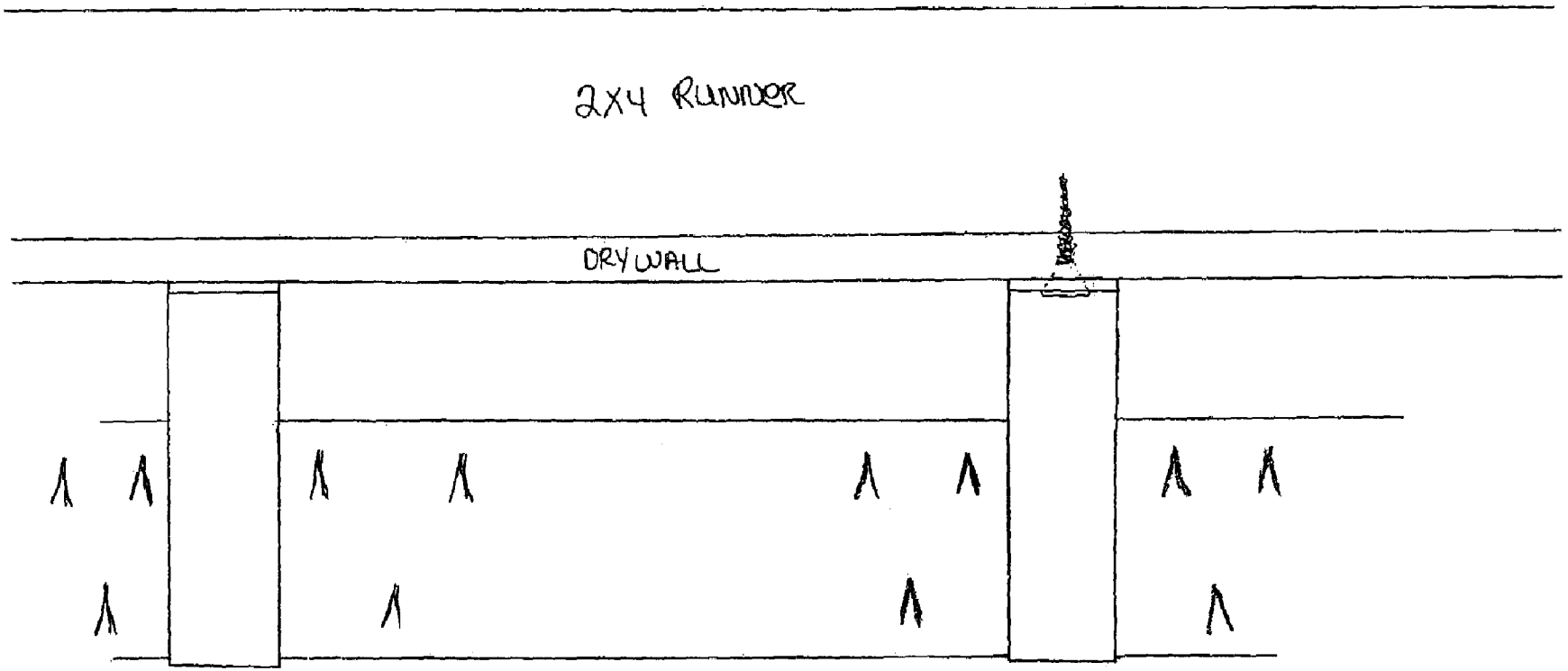
FIG. 3 is a top plan view of the bracket as installed in FIG. 1.

In FIGS. 1, 2 and 3 is shown the installation of a wood smooth edge strip 10 which is formed by a plywood strip having a body 11, a top surface 12, a bottom surface 13 and side edges 14 and 15. The plywood strip is arranged so that inclined nails or spikes project from the upper surface as indicated at 16 in a direction which is inclined to the upper surface an angle of the order of 45 degrees so as to project away from a carpet edge so as to hold the carpet against pulling in a manner that is well known to one skilled in the art.

The wood smooth edge is held in place by a bracket or clip 20. The bracket 20 includes a mounting plate 21 and a channel portion 22. The channel portion 22 includes an upper leg 23 and a lower leg 24 connected together at a base 25. The first or upper leg 23 and the second or bottom leg 24 define the channel which is shaped so that the upper leg lies flat on the upper surface between the spikes 16 and the lower leg lies against the under surface. Thus the width of the base 25 at right angles to the legs is equal to the thickness of the smooth edge. The lower leg 24 is relatively short so that it projects only partway underneath the strip so the strip can be readily inserted underneath by engaging over the upper surface of the bottom leg 24 and pushed against the base 25.

The upper leg 23 has a length equal to the width of the strip so that an apex 27 is located at the edge 14. At the apex 27, the leg is bent downwardly so as to form an incline portion 28 which extends from the edge of the strip downwardly toward a corner 29. The mounting plate 21 and the channel portion 22 are integrally formed in a strip which is of the order of 0.5 to 1 inches in width. This can preferably be formed by extruding the shape shown into a continuous length and cutting the length into individual bracket pieces having the required width.

Figure 4:
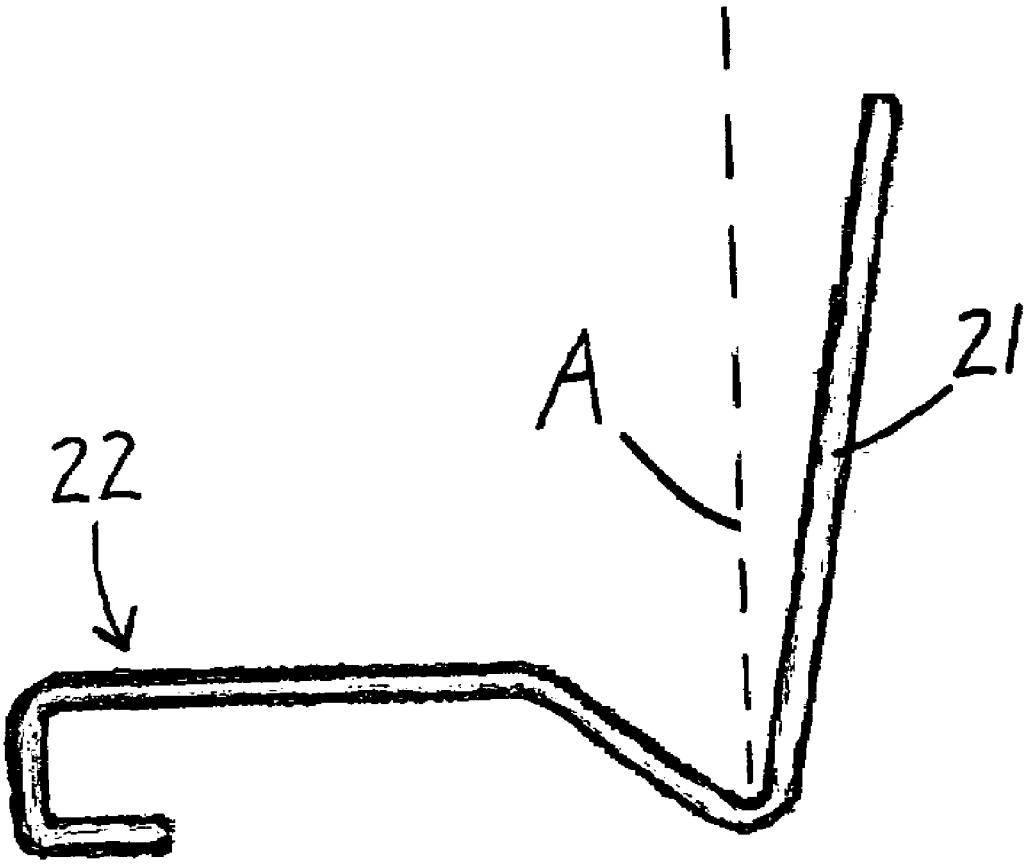
FIG. 4 is cross sectional view of the bracket of FIG. 1.

A shown in FIG. 4, when manufactured the mounting plate is arranged at an angle to the vertical which is indicated at A. Thus when the lower leg 24 is placed on the floor 30 and the mounting plate 21 is placed against the wall 31, the bracket is deformed by bending about the corner 29 thus providing a spring action tending to press the channel portion 22 downwardly onto the floor to hold the strip tight against the floor.

The incline portion 28 defines a section onto to which the carpet edge can be laid. The inclined portion defines the spacing of the strip from the wall since the strip is located by the apex 27. Thus the strip cannot move towards or away from the wall due to its retention within the channel portion. The use of an inclined portion 28 allows the strip to be readily inserted over the leg 24 and into the apex 27 taking into account slight variations in manufacturing tolerance so that the strip is slightly too wide it can still engage into the area and the corner adjacent the apex 27 may be compressed slightly but the strip will still fit into place.

It is desirable to install the under-pad right to the wall first then attach the metal clip to the wall. This way you can adjust for slight imperfections to the floor dips and always make sure the under-pad is cut close to the clip.

Each clip is preferably only one half inch wide so as to provide 288 clips per 12 foot length of material, which allows 288 feet of wood "smooth edge" to be anchored.

The "smooth edge" strip is laid out around perimeter (walls) and all nails from "smooth edge" either are removed by the installer or a "smooth edge" already void of nails is used. Clips are applied to the "smooth edge" at approximately 6"-12" intervals and by a screw or drywall screw. It is adhered to wall via 2×4 wood stud or rim joist. The carpet is then installed.

The clip is preferably formed of a suitable metal such as aluminum, but other materials can be used depending on strength and integrity. Other materials could be aluminium, steel, vinyl, copper, iron or fibreglass. Price factors have to be gauged accordingly.

The product could be manufactured by many different techniques including being press-formed, cast, injection molded or extruded and cut to length or pultruded and cut to length.

Since various modifications can be made in my invention as herein above described, and many apparently widely different embodiments of same made within the spirit and scope of the Claims without departing from such spirit and scope, it is intended that all matter contained in the accompanying specification shall be interpreted as illustrative only and not in a limiting sense.

The invention claimed is:

1. A combination comprising:

a wall;

a floor having a floor edge at the wall;

a smooth edge strip having a top surface, a bottom surface, an inner edge and an outer edge;

and a bracket for use in attachment of the smooth edge strip to the floor at a position adjacent to and spaced from the floor edge such that the inner edge of the smooth edge strip is spaced from the wall with the top and bottom surfaces generally parallel to the floor and the outer edge of the smooth edge located outwardly of the inner edge;

the bracket comprising:

an upstanding mounting plate attached to the wall at the floor edge by a fastener extending through a hole in the mounting plate with the mounting plate upstanding along the wall from a bottom end at the floor edge to a position above the floor edge;

and a channel portion for receiving and holding the smooth edge strip;

the channel portion being attached to the mounting plate and extending therefrom so as to extend across the floor so as to hold the smooth edge strip substantially flat on the floor;

the channel portion and the smooth edge strip being held in place on the floor solely by the engagement of the channel portion with the mounting plate;

the channel portion including a channel wall which includes:

a first portion which is inclined from the bottom end of the mounting plate at the floor edge upwardly and outwardly to meet the inner edge of the smooth edge strip at its junction with the top surface;

a second portion which extends across the top surface to the outer edge;

a third portion which extends down the outer edge to the bottom surface;

and a fourth portion which extends partly across the bottom surface toward the inner edge to an end edge of the fourth portion of the wall spaced outwardly of the inner edge.

2. The combination according to claim 1 wherein the mounting plate is inclined relative to the channel portion by an angle greater than 90 degrees so that when attached to the wall there is a spring biasing force applied to the channel portion tending to press the channel portion against the floor.

* * * * *